US007198590B1

(12) United States Patent
Nicholas

(10) Patent No.: US 7,198,590 B1
(45) Date of Patent: Apr. 3, 2007

(54) ALPINE SKI TRAINING APPARATUS

(76) Inventor: John Nicholas, 5484 Geoffrey Ave., Simi Valley, CA (US) 93063

( * ) Notice: Subject to any disclaimer, the term of this patent is extended or adjusted under 35 U.S.C. 154(b) by 0 days.

(21) Appl. No.: 11/236,955

(22) Filed: Sep. 28, 2005

(51) Int. Cl.
*A63B 69/18* (2006.01)

(52) U.S. Cl. ..... 482/71; 482/51; 434/253

(58) Field of Classification Search ..... 482/71, 482/79, 80, 146; 434/253
See application file for complete search history.

(56) References Cited

U.S. PATENT DOCUMENTS 3,912,260 A * 10/1975 Rice ..... 482/4
3,945,637 A * 3/1976 Simjian ..... 482/62
4,026,279 A * 5/1977 Simjian ..... 601/5
4,396,189 A * 8/1983 Jenkins ..... 482/71
5,290,211 A * 3/1994 Stearns ..... 482/53
5,499,956 A * 3/1996 Habing et al. ..... 482/52
5,575,739 A * 11/1996 Piaget et al. ..... 482/51
5,665,033 A * 9/1997 Palmer ..... 482/71
5,676,623 A * 10/1997 Yu ..... 482/53
6,508,746 B1 * 1/2003 Jacobs et al. ..... 482/71
2005/0049116 A1 * 3/2005 Huang ..... 482/51

* cited by examiner

*Primary Examiner*—Stephen R. Crow
*Assistant Examiner*—Allana Lewin

(57) ABSTRACT

A ski training apparatus is provided that simulate movement similar to alpine skiing. A pivoting arm is mounted at the base of the front vertical post and carries a parallelogram linkage assembly, with two flanged wheels mounted on the linkage assembly. A guide swivel is mounted on the floor base underneath the flanged wheels. Two horizontal and parallel foot platforms are mounted on the linkage assembly for rocking motion about vertical parallel axes. The pivoting arm, foot platforms, flanged wheels and guiding swivel constitute a low friction mechanism that provides the compound motion similar to that of alpine skiing. A holding bar and a padded lower back rest will maintain the body properly positioned.

14 Claims, 10 Drawing Sheets

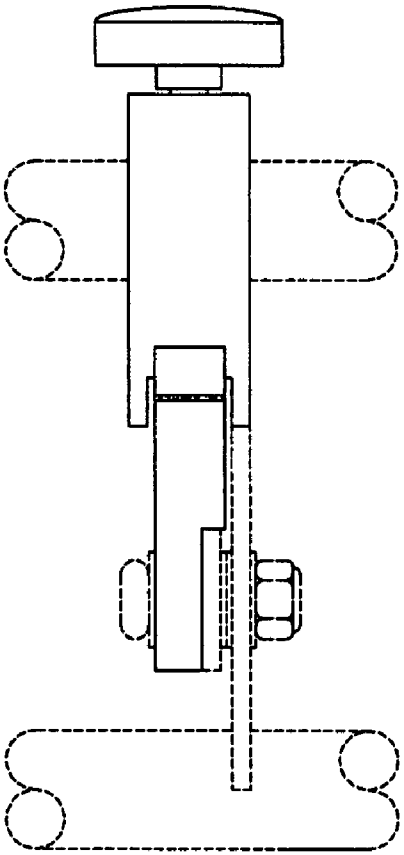
FIG. 8/B
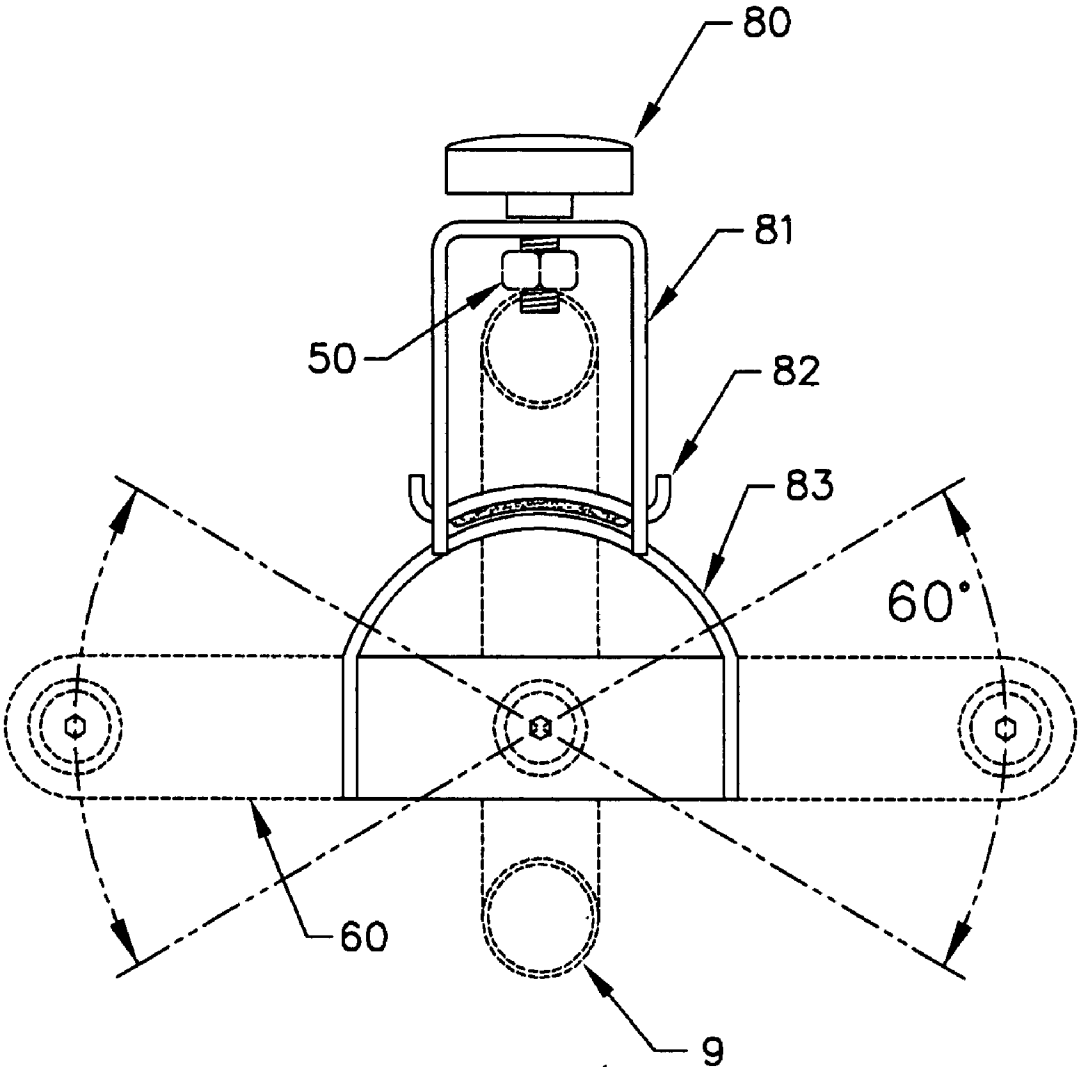
FIG. 8/A

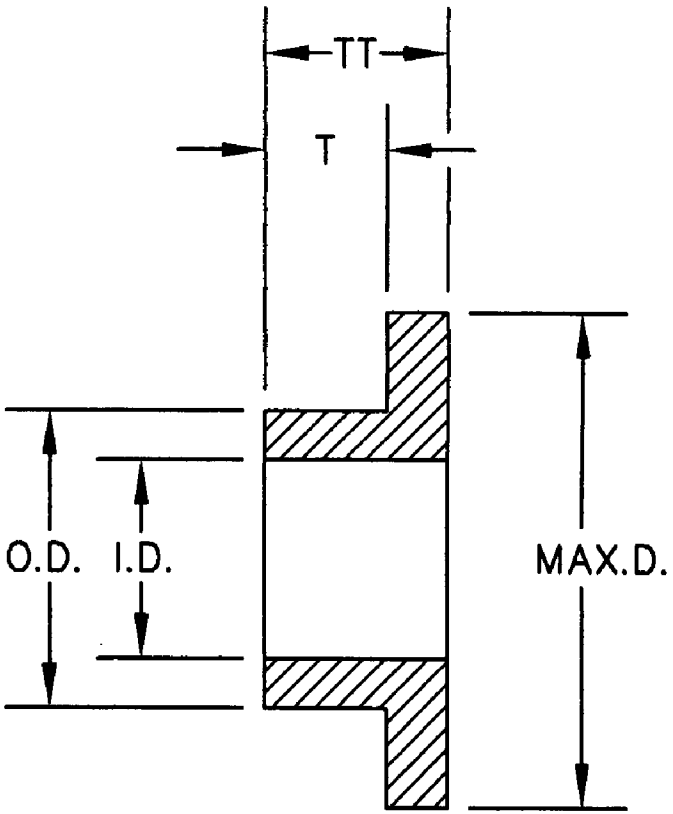
SECTION X–X
FIG. 10/C
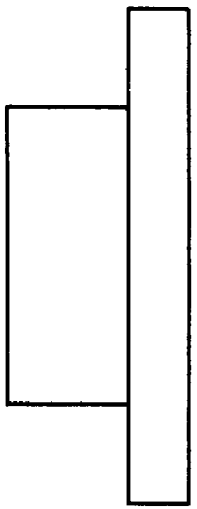
FIG. 10/B
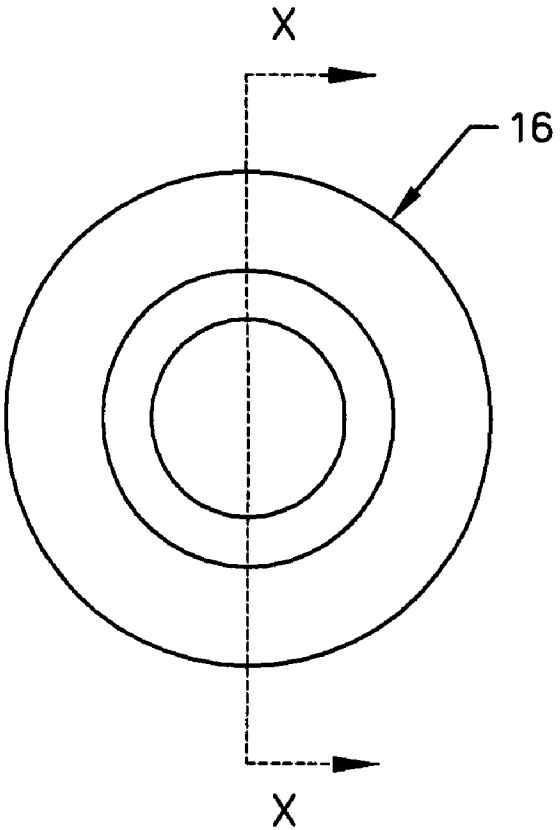
FIG. 10/A

ALPINE SKI TRAINING APPARATUS

BACKGROUND OF THE INVENTION

The present invention relates to the physical exercise equipment especially designed to provide proper body position and legs movement similar to those of alpine skiing.

Several ski simulating/training machines are known in the art. Designed in a variety of embodiments these devices show single or twin foot platforms with the ability to reproduce a more or less accurate alpine skiing simulated motion. Features like hand grips and variable or constant motion resistance are usually provided. Body weight shifting from one leg to another is made possible but generally the upper body is maintained in a position with the center of gravity rather high and lined up above the foot platform(s).

U.S. Pat. No. 4,629,181—Krive—Multi-directional movement leg exerciser: This exerciser shows a floor support base, "a turntable rotatably mounted on the base" and two foot supports "movable with respect to the turntable and with respect to one another" mounted on top of the turntable. The exerciser can provide a 360 degree rotation of the turntable and a multidirectional motion of the foot platforms.

U.S. Pat. No. 4,846,463—Kleinnibbelink—Alpine skiing training device: This device shows a floor support base frame with an inverted U shaped handlebar vertically fixed on the frame and a shaped transversal arm. One end of the arm is attached to the frame by means of one or two sleeve-bearings and the other end carries a single foot platform mounted on a bearing sleeve/spindle. Once weight is applied to the foot platform, the arm's "equilibrium position under the influence of gravity" can be changed to generating a pendulum inverted swinging motion.

U.S. Pat. No. 5,582,567—Chang,—Rocking type exerciser: This exerciser shows a snowboard like single foot platform mounted on a rectangular frame carrying arcuate tracks for rocking motion above multiple roller wheels fixed on a general support floor frame. The motion is controlled by means of multiple springs connecting foot platform's each end with the support floor frame. Two vertical bars and hand grips are individually mounted to the floor support frame.

U.S. Pat. No. 4,743,014—Loane—Ski exercising apparatus: This apparatus shows an H shaped floor support base with two short parallel members and long cross bar carrying a pair of arcuate rails. Two pivoting parallel foot platforms, connected by links, are mounted on the top of a carriage riding on the rail set by means of ball bearing wheels. Flexible straps are provided for resistance and side to side rocking motion control.

U.S. Pat. No. 5,749,811—Wilson—Skiing simulator: This simulator shows an H shaped floor support base with two vertical bars and hand grips fixed on frame's front horizontal member and a track mounted on frame's rear horizontal member. Two multiple axis pivoting foot platforms can slide independently along the track from side to side. Foot platforms motion is controlled by means of "a chord extending around a pulley attached to . . . a single tension spring" anchored to the base frame.

U.S. Pat. No. 6,231,484—Gordon—Ski simulating exercise machine: This exercise machine shows two elongated arms/foot platforms connected to a frame by means of joints and variable length pivot rods where the system's multiple axis motion resistance is controlled by means of "springs or oil damper type cylinders". An U shaped handle bar on a generally vertical post is pivotally connected to the frame and to the cylinder/foot platform arms assembly by a tie bar providing for a simultaneous movement of the system.

U.S. Pat. No. 5,391,130—Green, et al.—Leg exerciser: This exerciser shows "two four bar linkage with side by side foot pads for providing a lateral sliding motion resistively controlled by means of "double acting hydraulic cylinders". An adjustable C shaped handle bar on a vertical post is mounted on the frame.

U.S. Pat. No. 4,869,496—Colombo—Equipment for ski movement simulation: This equipment shows a floor support frame carrying a pivoting arm that can "oscillate horizontally . . . able to carry out a slight vertical oscillation". Two multiple axis pivoting foot platforms" are restrained to the arm and series of rods tie rods are provided for synchronized motion of the arm; foot platforms and two vertical hand bars also mounted on the arm. Arm's horizontal oscillation is controlled by elastic means while an electrical circuit system detects and signals out of range movements.

U.S. Pat. No. 5,692,995—Alvarez, et al.—Ski simulating exercise machine: This machine shows "a pair of elongated foot support arms . . . for limited rotation movement about separate axis" and a "gear train interconnecting each of the foot support arms to coordinate movement . . . in a predetermined coordinated manner" mounted on a floor support base. Rubber stud bumpers are provided for motion limiting, along with a belt and pulley brake system for resistance to movement adjustment.

U.S. Pat. No. 5,665,033—Palmer—Ski simulating exercise machine: This machine seems to be of a similar basic design to U.S. Pat. No. 5,692,995—Alvarez, showing a full floor support frame with two hand bars and grips mounted on the support frame and a common system of adjustable hydraulic fluid flow piston/cylinder assemblies to control the simultaneous motion of foot platforms and hand bars.

SUMMARY OF THE INVENTION

Skiing is a seasonal sport and "dry land" training is always needed before an upcoming season. Poor physical condition can lead to excessive fatigue, muscle cramps and often to various injuries.

The present invention provides the necessary movement patterns required for the proper training of the specific muscles used in alpine skiing. Cardiovascular conditioning is combined with two distinctive muscle training techniques: the "wall seat" body position and the simulation of alpine skiing leg motion.

A distinguishing characteristic of the present invention is the supporting frame design, comprising a front vertical post with a handle bar and a rear vertical post with a padded lower back rest. The handle bar and the lower back rest are designed to maintain the human body in to the "wall seat" position (with the knees lined up over the ankles and the legs parallel to the ground), while the moving mechanism is simulating the motion of alpine skiing. This position requires a high degree of muscular endurance: Gluts and Quads in general and Hamstrings when curling toes up. The lower back support position is adjustable to accommodate the height of various personnel.

Another distinguishing characteristic of the present invention is the originality of the mechanism design.

Once pressure is applied to a foot platform, the swivel guide rotates guiding the flanged wheels, the interconnecting linkage, the foot platforms and the pivoting arm generating a simultaneous coordinated motion.

When the body weight is on the right foot, the right foot platform will travel down, the pivoting arm will rotate counterclockwise and the left foot platform will travel up simulating a skiing left turn.

When the body weight is shifted to the left foot, the left foot platform will travel down travel down, the pivoting arm will rotate clockwise and the right foot platform will travel up simulating a skiing right turn.

The pivoting arm can rotate horizontally on a vertical axis through an angle of approx 30 degrees from side to side.

Each foot platform can travel 4" (approx 100 mm) from the highest to the lowest position.

The swivel guide has a predetermined shape so that the rotation of the pivoting arm and the travel of the foot platforms become a characteristic motion similar to that of alpine skiing.

In order to compensate for wear on the flanged wheels a pivoting arm vertical position adjustment feature is provided.

The repetitiveness of this motion will increase specific muscle strength and can simulate a real life alpine skiing dynamic stereotype.

User's body weight is the intended driving force of the mechanism.

Optional, air springs/dumper cylinders can be added to the mechanism.

All pivoting points are provided with low friction bushings for a smooth motion and only the adjustable friction and control system allows for variations of the resistance of the mechanism.

The apparatus is of metallic construction with metallic components, low friction bushings and nylon flanged wheels providing a long life and safe operation.

An commercially available monitoring system, mounted on the front vertical post near the handle bar, can provide information such as elapsed time from start to finish of workout, number of strides and estimated energy or calories expended by the user.

The present invention which is primarily designed to offer a reliable off season training apparatus for alpine skiers of all kinds can be used as well as a training apparatus during the ski injury recovery period.

BRIEF DESCRIPTION OF THE DRAWINGS

The present invention is illustrated by way of example and not limitation in the accompanying drawings, in which like references indicate like parts.

FIG. 8A is a side view of a preferred resistance adjustment and control assembly.

FIG. 8B is a front view of a preferred resistance adjustment and control assembly.

FIG. 10A is a front view of a preferred lower friction bushing.

FIG. 10B is a side view of a preferred lower friction bushing.

FIG. 10C is a cross section taken on the cutting plane X—X of FIG. 10A.

DETAILED DESCRIPTION OF THE INVENTION

Figure 1:
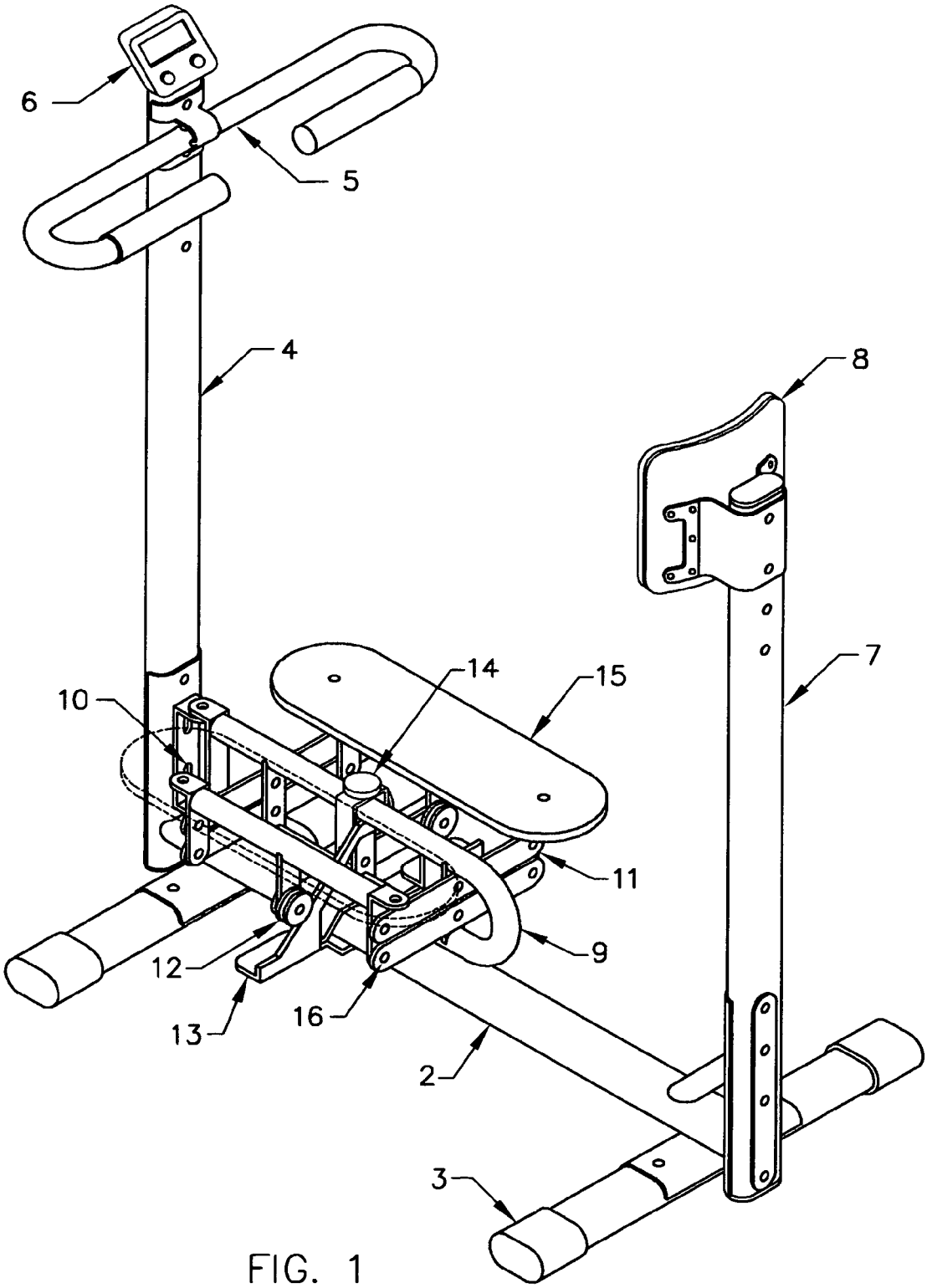
FIG. 1 is an isometric view of a preferred embodiment of the invention.

As shown in FIG. 1, the preferred body of the present invention incorporates a modular, floor positioned support frame including the base (2) and the two vertical posts (4) and (7). An adjustable position holding bar (5) is mounted on the front post (4) and an adjustable position padded lower back rest (8) is mounted on the rear vertical post (7). The pivoting arm (9) is mounted at the base of the front vertical post (4) for horizontal rotation on the front vertical post (4) about a vertical axis. The pivoting arm (9) is carrying the parallelogram linkage assembly (11), two flanged wheels (12) and the resistance adjustment and control system (14). The resistance adjustment and control system (14) is mounted on the arm (9) and the linkage (11). A guiding swivel (13) is mounted on the floor base (2) underneath the flanged wheels (12). Two horizontal and parallel foot platforms (15) are mounted on the linkage (11) for rocking motion about vertical parallel axes. All pivoting points are provided with low friction, powder metallurgy type bushings (16). The pivoting arm (9), the foot platforms (15), the flanged wheels (12) and the swivel (13) constitute a low friction moving mechanism while the holding bar (5) and the padded lower back rest (8) allows the human body to be properly positioned while training.

Figure 2:
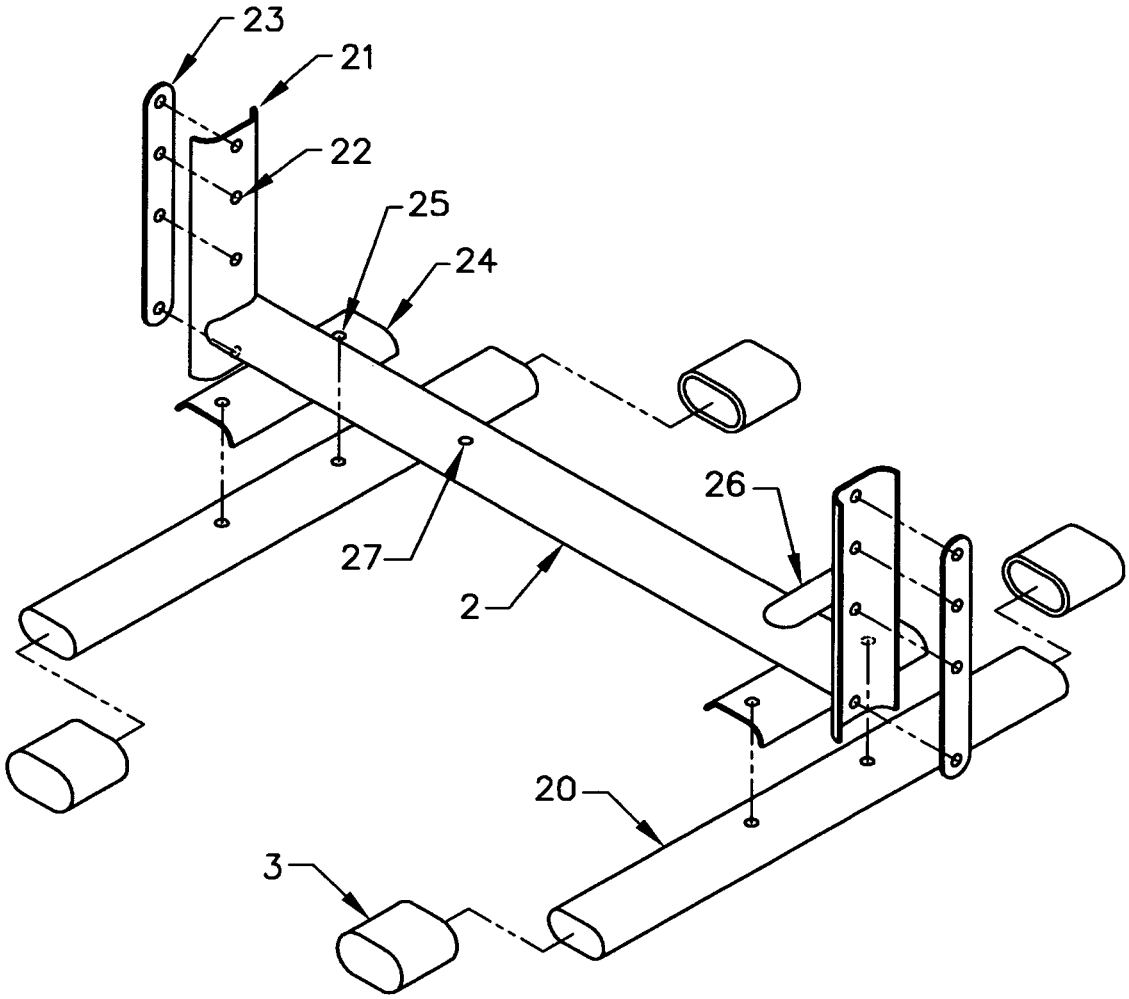
FIG. 2 is an exploded isometric view of a preferred support frame showing the modular horizontal floor base and the floor base end caps.
Figure 7:
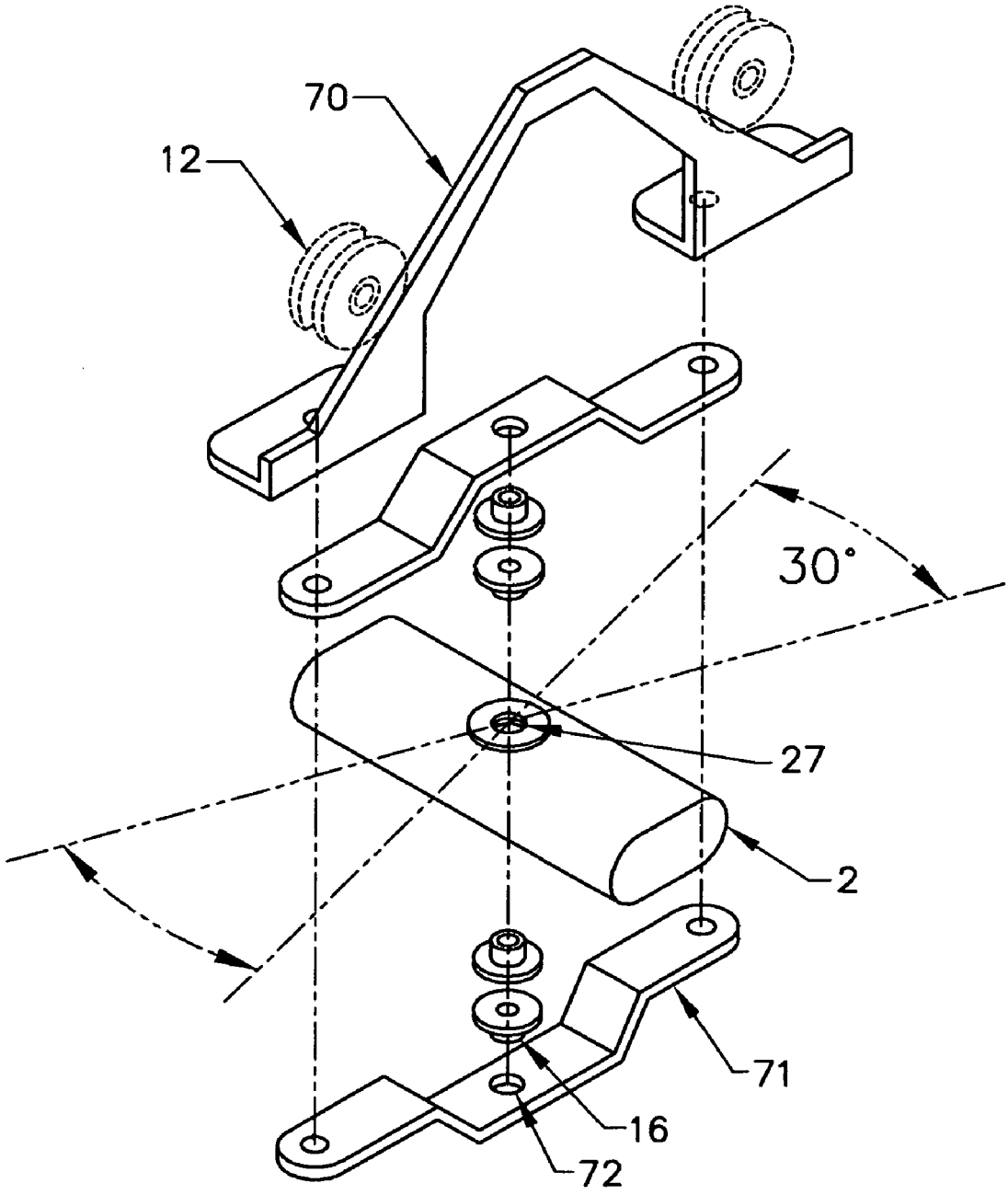
FIG. 7 is an exploded isometric view of a preferred swivel guiding system and the low friction bushings.

As shown in FIG. 2, the modular floor base is comprised of a horizontal beam (2) and two parallel floor support members (20) with eccentric end caps (3). The horizontal beam (2) has two welded end plates (21); each end plate (21) has four mounting holes (22) to match the pattern of the vertical posts (4) and (7) holes (as shown in FIG. 1). For frame/vertical posts installation two back plates are provided (23); each end plate (23) has four holes to match the pattern of the vertical posts end plates holes (22). The horizontal beam (2) also has two welded bottom plates (24); each bottom plate (24) has two holes (25) to match the pattern of the two parallel floor supports (20) mounting holes. The horizontal beam (2) and the rear end plate (21) have a 45 degree welded gusset (26). At a predetermined fixed location the horizontal beam (2) has a vertical thru hole (27) to accommodate two low friction bushings and the swivel (as shown in FIG. 7). The modular floor base (2) and the parallel floor supports (20) shall be manufactured of oblong rounded steel tubing sized to accommodate a maximum user weight of 300 lb. The installation hardware shall include all the required steel bolts, washers and all steel locking nuts (not shown).

Figure 3:
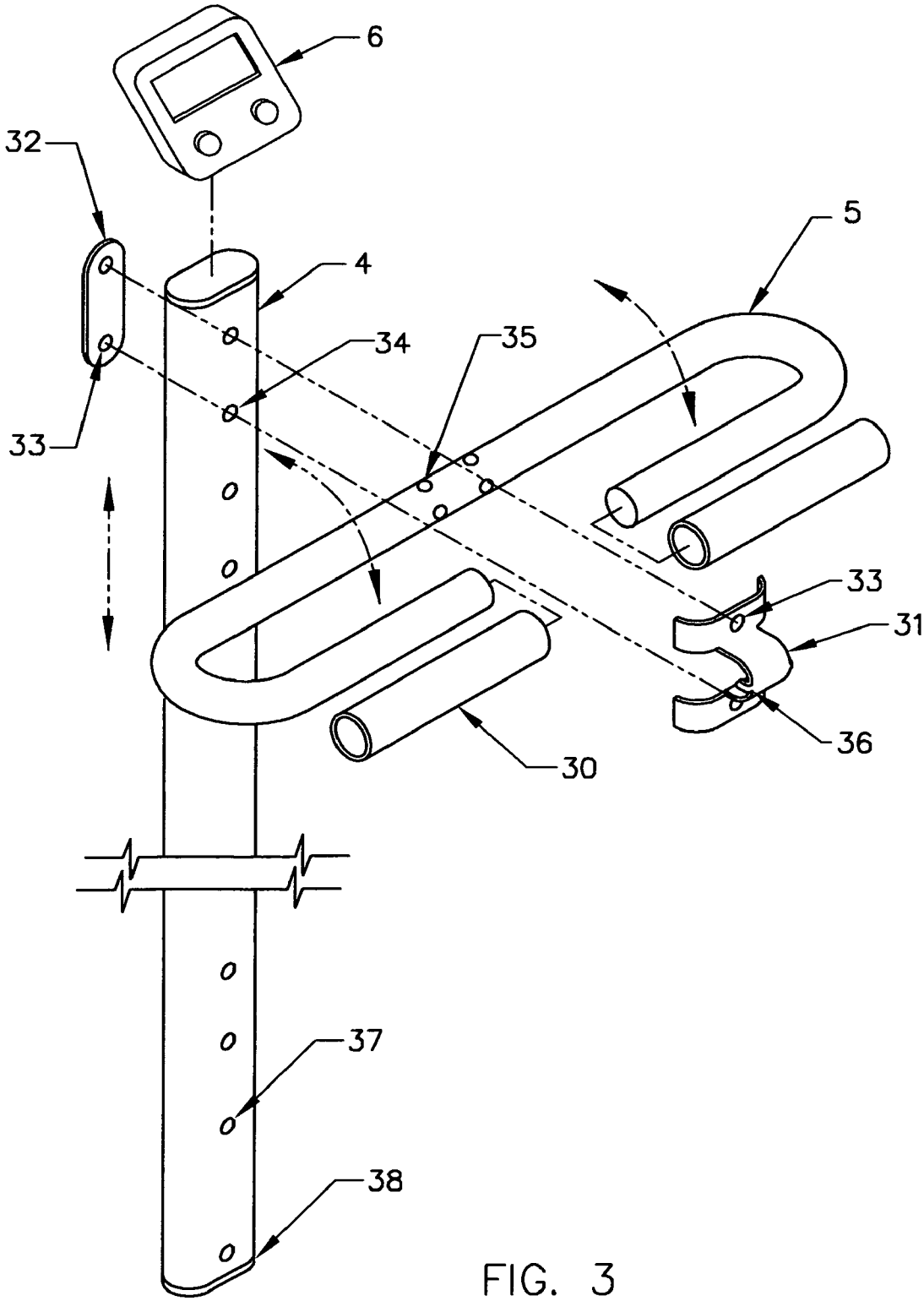
FIG. 3 is an exploded isometric view of a preferred front vertical post showing the handle bar the monitoring system, the hand grips, and the handle bar position adjusting system.

As shown in FIG. 3, the front vertical post (4) carries a C shape holding bar (5) with rubberized hand grips (30) and the monitoring module (6). The holding bar (5) may be mounted at any one of the height options, using the four equidistant holes (34) provided at the top of the front vertical post (4). The mounting bracket (31) and the back plate (32)

have mounting holes (33) to match the upper equidistant holes (34) of the front vertical post (4). The holding bar has a set of four holes (35) matching mounting bracket's (31) two external tabs (36): two holes are drilled horizontally and the other two vertically so that the handle bar (5) can be mounted on a vertical (with the hand grips higher and forward, position not shown) or a horizontal position (with the hand grips lower and back) in relation with the front vertical post (4). At the bottom the front vertical post (4) has a set of four installation holes (37) matching the pattern of the modular floor base front end plate holes (22) shown in FIG. 2. The front vertical post (4) shall be manufactured of the same material as the floor base (2) and fitted with plastic end plugs (38). The holding bar (5) shall be manufactured of appropriate diameter steel tubing and fitted with rubberized hand grips (30) and plastic end plugs (not shown). The installation hardware shall include all the required steel bolts, washers and all steel locking nuts (not shown).

Figure 4A:
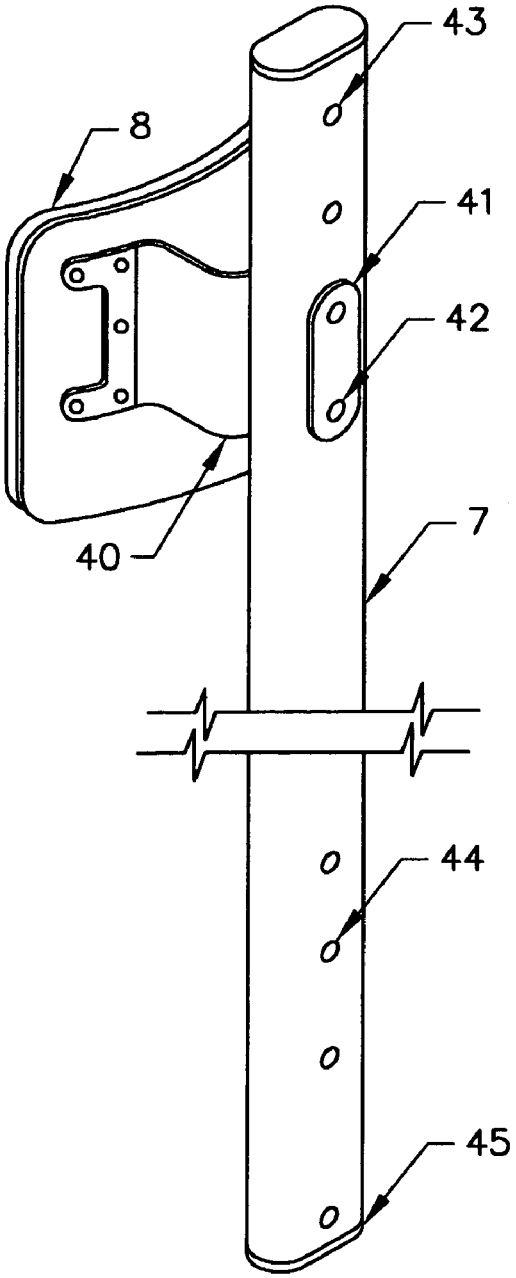
FIGS. 4A and 4B show isometric views of a preferred rear vertical post with the lower back rest mounted in to different positions.

As shown in FIG. 4A, the rear vertical post (7) carries the lower back rest (8) mounted to the extreme lower and forward position as required for a lower height user. The lower back rest (8) may be mounted at any one of the height options, using the four equidistant holes (43) provided at the top of the rear vertical post (7). The mounting bracket (40) and the back plate (41) have two mounting holes (42) to match the upper equidistant holes (43) of the rear vertical post (7). At the bottom the rear vertical post (7) has a set of four installation holes (44) matching the pattern of the modular floor base front end plate holes (22) shown in FIG. 2. The rear vertical post (7) shall be manufactured of the same material as the floor base (2) and fitted with plastic end plugs (45). The lower back rest (8) shall be manufactured of injected or molded plastic and padded. The installation hardware shall include all the required steel bolts, washers and all steel locking nuts (not shown).

Figure 4B:
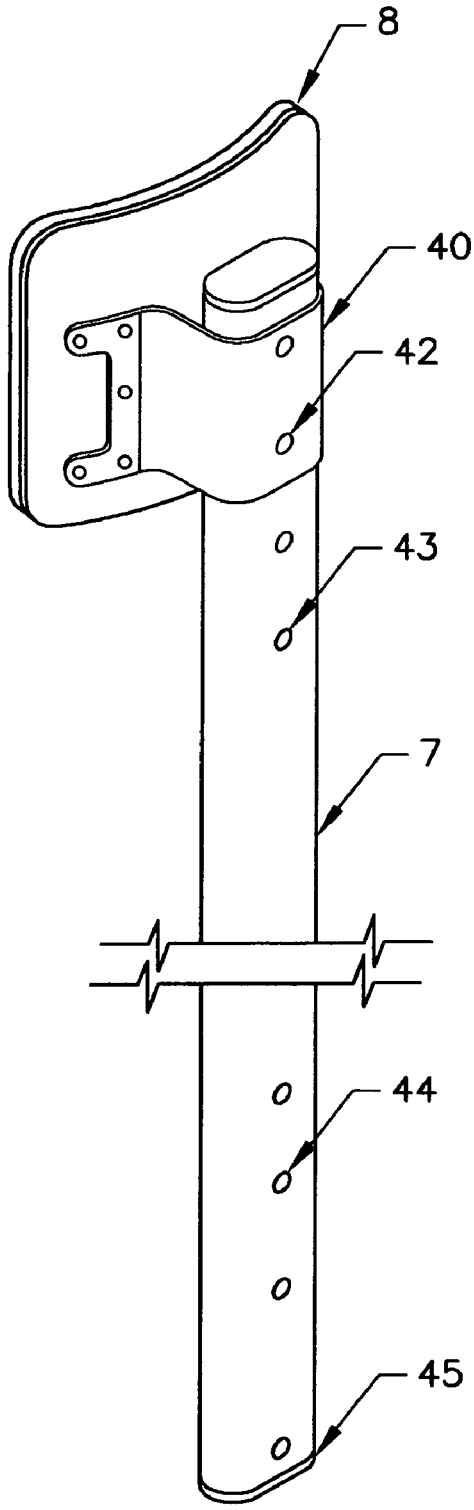

As shown in FIG. 4B, the rear vertical post (7) carries the lower back rest (8) mounted to the extreme higher and back position as required by a tall user (see FIG. 4A for detailed description).

Figure 5:
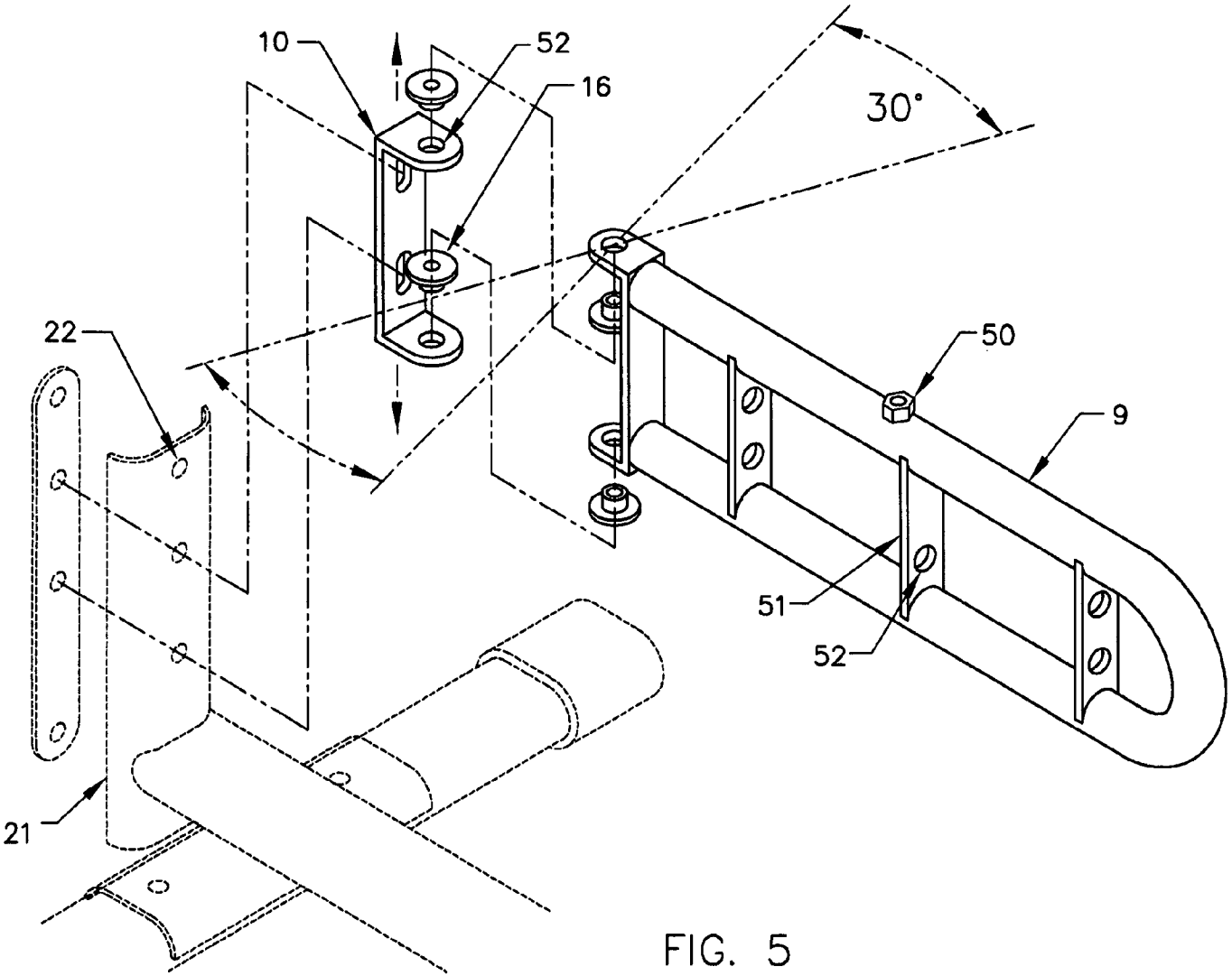
FIG. 5 is an exploded isometric view of a preferred pivoting arm, the position adjusting system and the low friction bushings.

As shown in FIG. 5, the pivoting arm (9) is an all steel assembly comprised of the main arm body (9) and a slotted C bracket (10) which provides for pivoting arm's (9) vertical position adjustment. The main arm body (9) is made of a C bracket similar to the steel C bracket (10) without the slotted holes, welded to an elongated U shape tubing. At a predetermined location a hex nut (50) is welded on top of the main arm (over a top wall only predrilled hole) to accommodate the friction control and adjustment knob (as shown in FIG. 8B). The hex nut (50) will have matching thread with the knob. The main arm body (9) has also three steel vertical members (51) welded at predetermined locations to accommodate the linkage (11) shown in FIG. 6. Except for the two slotted holes, all other arm's assembly holes (52) must match the outside diameter (O.D.) of the low friction bushings (16) for a press fit (pivoting points). A total of four low friction bushings (16) are required for the pivoting arm (9) assembly. Socket head, high grade steel bolts, washers and all steel locking nuts are required for each pivoting point (not shown). The C bracket's two slotted holes (10) shall match two of the corresponding holes (22) of the modular floor base front end plate (21) shown in FIG. 2 (pivoting arm's vertical position adjustment). The pivoting arm (9) can rotate horizontally on a vertical axis a total of approx. 30 degrees from side to side (motion parameters are predetermined by the by the shape of the swivel guide identified as No. 13 in FIG. 7).

Figure 6:
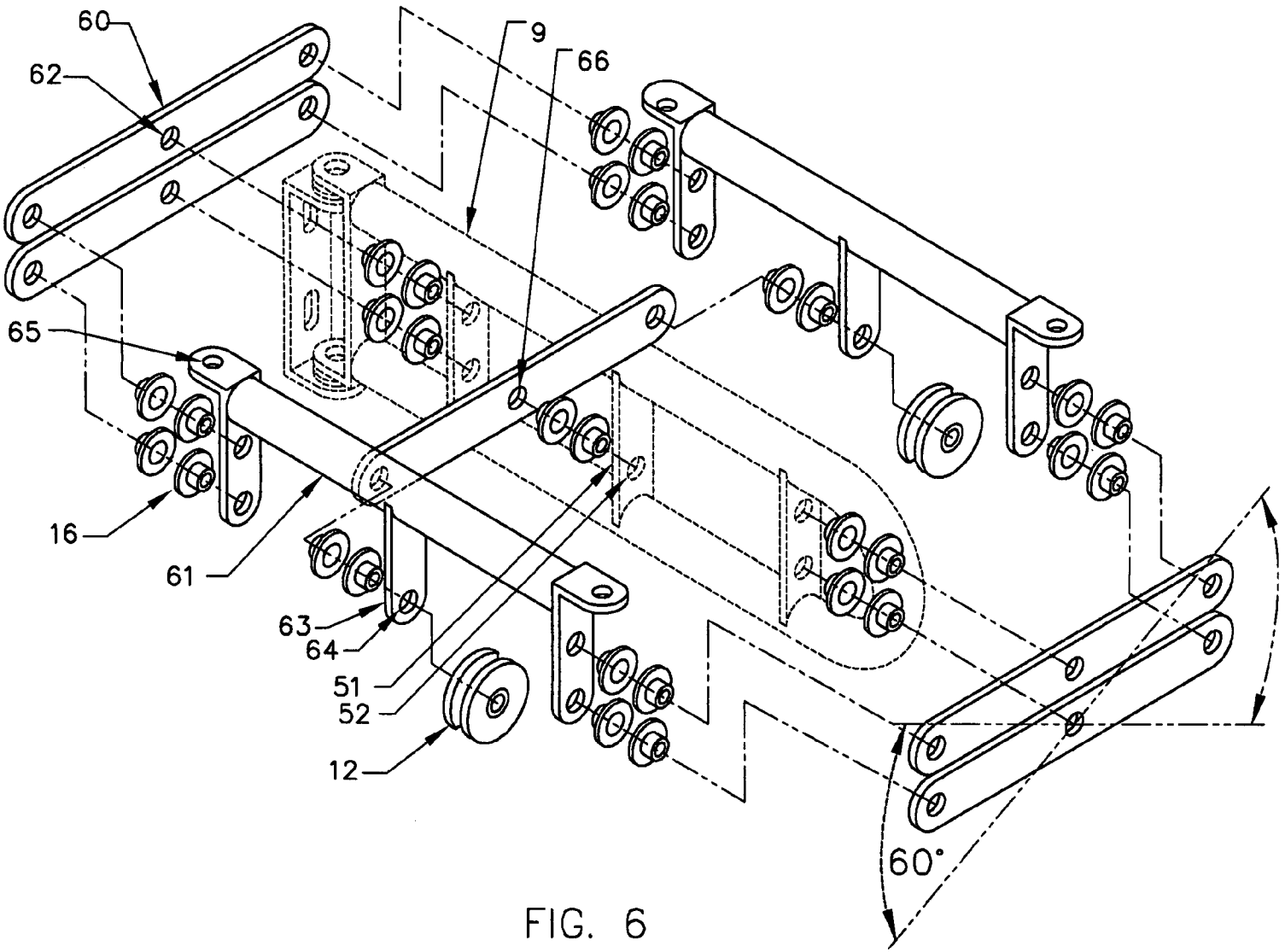
FIG. 6 is an exploded isometric view of a preferred parallelogram linkage, the two flanged wheels and the low friction bushings.

As shown in FIG. 6, the all steel linkage assembly (identified as No. 11 in FIG. 1) is comprised of five flat bars (60) and two foot platform supports (61). All five flat bars are identical with equidistant holes (62) matching the outside diameter (O.D.) of the low friction bushings (16) for a press fit (pivoting points). The two foot platform supports (61) are made of a horizontal tubing section with three vertical members (63) welded at locations corresponding with the locations of the vertical members (51) of the pivoting arm (9). The foot platform supports vertical members holes (64) pattern must match the pivoting arm (9) vertical members holes (52) pattern so that when the flat bars (60) and the foot platform supports (61) are connected together will constitute a parallelogram linkage carried by the pivoting arm (9). The foot platform supports (61) have top holes (65) to match the foot platforms (15) holes pattern (shown in FIG. 9). The vertical members (63) must have holes (64) of the same diameter as the outside diameter (O.D.) of the low friction bushings (16) for a press fit (pivoting points). The middle flat bar (60) has the ends connected to the foot platforms (61) middle vertical members (63), pivoting point and carries the two flanged wheels (12). The center of the flat bar, hole (66) is connected to the pivoting arm (9) middle vertical member, hole (52), pivoting point. The middle flat bar (60) also carries the friction adjustment and control drum (shown as No. 83 in FIG. 8B). A total of thirty low friction bushings (16) are required for linkage (11) and pivoting arm (9) assembly. Socket head, high grade steel bolts, washers and all steel locking nuts are required for each pivoting point (not shown). The flat bars (60) can rotate vertically on a horizontal axis a total of approx 60 degrees and each foot platform support (61) can travel approx. 4" (100 mm) from the highest to the lowest position. Motion parameters are predetermined by the shape of the swivel guide (13) shown in FIG. 7.

As shown in FIG. 7, the swivel guide (identified as No. 13 in FIG. 1) is an all steel assembly comprised of one double edge guide (70) and two identical support brackets 71. The edges of the guide (70) are custom shaped in order to predetermine the motion parameters of the entire mechanism, guiding the flanged wheels (12) mounted on the linkage (11) and the pivoting arm (9) as shown in FIG. 6. The support brackets (71) have center holes (72) matching the outside diameter (O.D.) of the low friction bushings (16) for a press fit (pivoting point). A total of four bushings are required for the swivel guide assembly (13) to be mounted on the floor base transversal beam (2), hole (27). Hex socket head, high grade steel bolts, washers and all steel locking nuts (not shown) are required for the pivoting point. The guide (70) and the support brackets (71) can be fastened together using standard steel hardware (not shown). The swivel guide assembly (13) can rotate horizontally a total of approx. 30 degrees on a vertical axis.

FIG. 8A is a front view of the resistance adjustment and control system, identified as (14) in FIG. 1. The resistance of the system can be increased when the knob (80) is rotated clockwise in which case pressure is applied to the bracket (81) and the pad (82) against the drum (83). The drum (83) is fixed to the linkage middle flat bar (60) and follows the motion of the linkage rotating vertically approx. 60 degrees about the horizontal axis. The pad (82), the bracket (81) and the knob (80) are kept stationary by the fixed hex nut (50), pivoting arm (9). The resistance of the system can be decreased when the knob (80) is rotated counterclockwise. The knob (80) is of plastic material with a steel bolt insert to have matching thread with the hex nut (50).

FIG. 8B is a side view of the resistance adjustment and control system (14).

Figure 9:
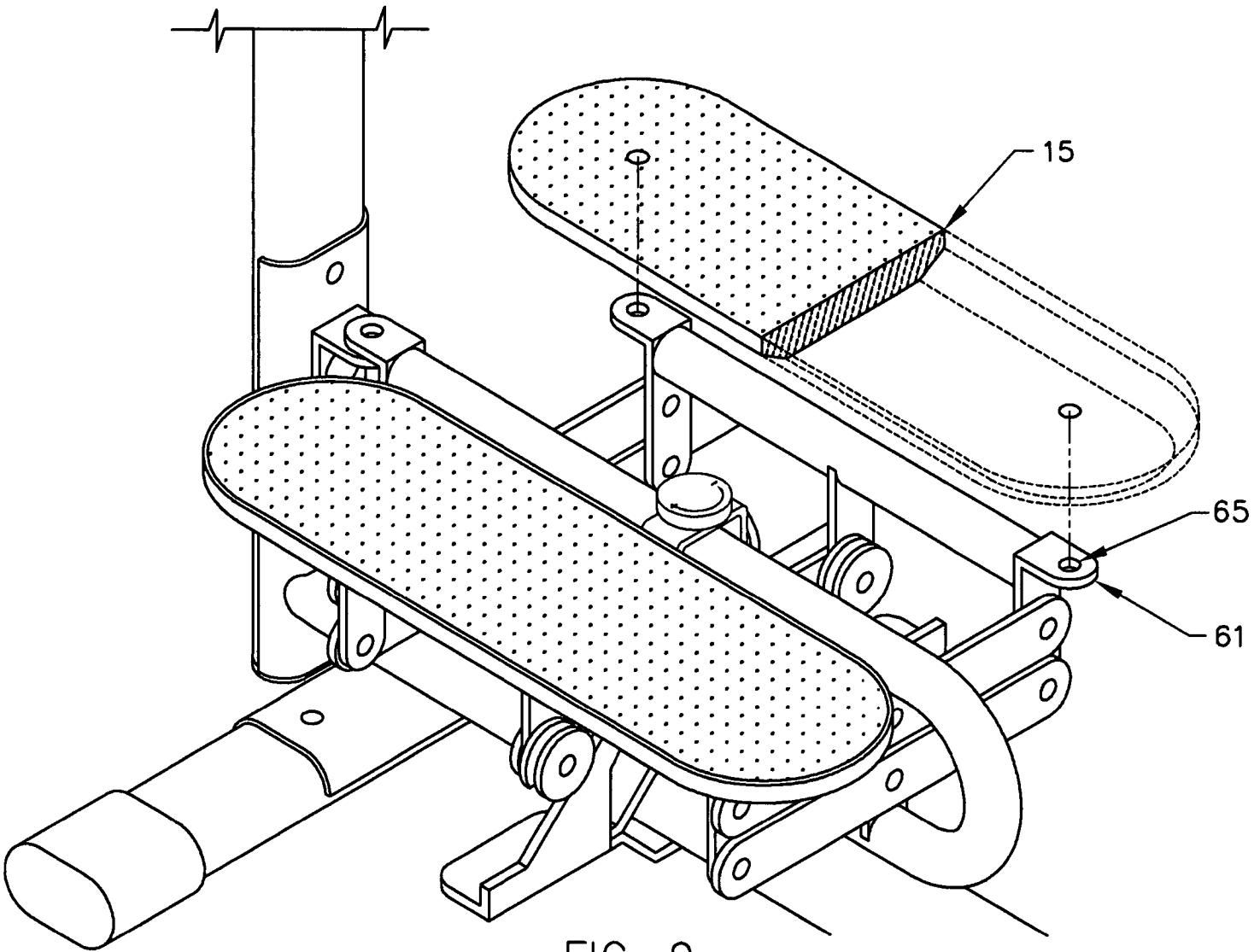
FIG. 9 is an isometric view of a preferred set of foot platforms.

As shown in FIG. 9, the two foot platforms (15) are bolted to the foot platform supports (61), top holes (65), bolts are not shown. The foot platforms (15) are made of injected/molded plastic material suitable to bear a maximum weight of 300 lb. The motion of the foot platforms (15) coincides with that of the linkage foot platform supports (61), approx 4" (100 mm) from the highest to the lowest position.

FIG. 10A is front view of a low friction bushing (16).

FIG. 10B is a side view of a low friction bushing (16).

FIG. 10C is a typical cross section of a low friction bushing (16) taken on the cutting plane X—X. The low friction bushings (16) must be of powder metallurgy type, made of oil impregnated brass or steel alloy. The inside diameter (I.D.) requires a proper tolerance for a bolt fit with minimum clearance, the outside diameter (O.D.) is a requirement for all the parts of the apparatus which have matching holes (pivoting points) and the (MAX.D) shall be 2×O.D. The depth (T) must be the same as thickness of the steel materials used to manufacture all parts of the apparatus which have pivoting points, while the total depth (TT) shall be 1.5×T.

The invention claimed is:

1. A ski training apparatus comprising:

floor positioned modular support frame, the aforementioned frame including a modular base, a front vertical post, and a rear vertical post, with a handle bar mounted on the aforementioned front post and a padded lower back rest mounted on the aforementioned rear vertical post;

a pivoting arm mounted on the aforementioned front vertical post for horizontal pivotal movement on the aforementioned front vertical post about a vertical axis;

the aforementioned pivoting arm carrying a parallelogram linkage assembly, two flanged wheels mounted on the aforementioned linkage assembly and a resistance adjustment and control system also mounted on the aforementioned arm and linkage assembly;

a guiding swivel mounted on the aforementioned floor base underneath the flanged wheels;

two horizontal and parallel foot platforms mounted on the abovementioned linkage assembly for rocking motion about vertical parallel axes;

whereby a user stepping on the foot platforms applies pressure to one of said foot platforms thereby causing compound lateral and vertical motion of the platforms.

2. The ski training apparatus according to claim 1 has an H shape modular horizontal floor base comprised of two parallel members and a transversal beam.

3. The ski training apparatus according to claim 2 has four eccentric end caps mounted at the ends of parallel members.

4. The ski training apparatus according to claim 1 wherein said handlebar is a holding bar mounted at an upper portion of said front vertical post and said holding bar having rubberized hand grips.

5. The ski training apparatus according to claim 4 wherein the position of said holding bar is adjustable.

6. The ski training apparatus according to claim 1 has an integrated monitoring system mounted on said front post.

7. The ski training apparatus according to claim 1 wherein said lower back rest is mounted at an upper portion of said rear vertical post.

8. The ski training apparatus according to claim 7 wherein the position of said lower back rest is adjustable.

9. The ski training apparatus according to claim 2 wherein said pivoting arm is mounted on said front vertical post below said hand grips and above said transversal beam.

10. The ski training apparatus according to claim 9 wherein a vertical mounting position of said pivoting arm is height adjustable.

11. The ski training apparatus according to claim 2 has a swivel guiding system mounted underneath said flanged wheels for pivotal movement on said transversal beam about a vertical axis.

12. The ski training apparatus according to claim 1 all pivoting points have low friction bushings.

13. The ski training apparatus according to claim 1 has a resistance adjustment and control system mounted on said linkage assembly with a hand adjustment mounted on said pivoting arm.

14. The ski training apparatus according to claim 1 wherein said foot platforms have non skid top surfaces.

* * * * *